US010513956B2

(12) United States Patent
Fahri

(10) Patent No.: US 10,513,956 B2
(45) Date of Patent: Dec. 24, 2019

(54) MUFFLER ASSEMBLY

(71) Applicant: Tarkan Fahri, Moorebank (AU)

(72) Inventor: Tarkan Fahri, Moorebank (AU)

(73) Assignee: Tarkan Fahri, Moorebank, New South Wales (AU)

( * ) Notice: Subject to any disclaimer, the term of this patent is extended or adjusted under 35 U.S.C. 154(b) by 269 days.

(21) Appl. No.: 15/663,365

(22) Filed: Jul. 28, 2017

(65) Prior Publication Data

US 2018/0030869 A1 Feb. 1, 2018

(30) Foreign Application Priority Data

Jul. 28, 2016 (AU) ..... 2016902962

(51) Int. Cl.
*F01N 1/16* (2006.01)
*F01N 1/24* (2006.01)

(52) U.S. Cl.
CPC ..... *F01N 1/165* (2013.01); *F01N 1/24* (2013.01)

(58) Field of Classification Search
CPC ..... F01N 1/006; F01N 1/163; F01N 1/165; F01N 1/166; F01N 1/168; F01N 2470/14; F01N 2470/24; F01N 2490/02; F01N 2490/04
USPC ..... 181/239, 254, 248, 264, 268, 272, 275
See application file for complete search history.

(56) References Cited

U.S. PATENT DOCUMENTS 4,333,544 A * 6/1982 Seeger ..... F01N 1/02 181/266
4,700,806 A * 10/1987 Harwood ..... F01N 1/02 181/239
4,712,644 A * 12/1987 Sun ..... F01N 1/003 181/251
4,913,260 A * 4/1990 Fallon ..... F01N 1/02 137/487.5
5,198,625 A * 3/1993 Borla ..... F01N 1/04 181/248
7,506,723 B2 * 3/2009 Hoerr ..... F01N 1/003 181/250
8,469,142 B2 * 6/2013 Feng ..... F01N 1/085 181/254
8,550,210 B2 * 10/2013 Kondou ..... F01N 1/023 181/251
8,607,923 B2 * 12/2013 Takagaki ..... F01N 1/02 181/227
8,763,384 B2 * 7/2014 Takagaki ..... F01N 1/02 137/527.6
9,617,882 B1 * 4/2017 Horr ..... F01N 1/023
10,196,947 B2 * 2/2019 LeRoy ..... F01N 1/083
2006/0054381 A1 * 3/2006 Takemoto ..... F01N 1/003 181/237
2012/0024507 A1 * 2/2012 Paze ..... F01N 1/166 165/138
2017/0335741 A1 * 11/2017 Kruger ..... F01N 1/026
2019/0085744 A1 * 3/2019 Kishikawa ..... F01N 1/089

* cited by examiner

*Primary Examiner* — Jeremy A Luks
(74) *Attorney, Agent, or Firm* — Kilpatrick Townsend & Stockton LLP

(57) ABSTRACT

A muffler assembly (10) that includes a first exhaust gas outlet portion (51), and a second exhaust gas outlet portion (52), with a valve (12) being operable to determine the volume of gas leaving through each outlet portions (51, 52) to govern the resistance of exhaust gas flowing through the muffler assembly (10).

6 Claims, 2 Drawing Sheets

MUFFLER ASSEMBLY

FIELD

The present invention relates to muffler assemblies for internal combustion engines, and more particularly but not exclusively to muffler assemblies for motor vehicles that have an internal combustion engine.

BACKGROUND

Motor vehicles, such as motor cars and bikes, and motor lorries, are provided with an internal combustion engine. The engine has an exhaust system including a muffler.

Standard mufflers have a single path through the muffler casing. More advanced exhaust systems include one or more mufflers, with a number of differently sourced paths, with various exhaust paths being open and closed (or fixed with closed paths) depending on the operating speed of the engine, that is the exhaust flow rate.

Standard exhaust systems are known to provide a first exhaust path having a first flow resistance and therefore a back pressure, while performance after market exhaust systems have a second flow path in which the resistance is reduced (lower back pressure) to provide for improvement in performance.

A disadvantage of known exhaust systems having a muffler or muffler assembly providing a plurality of flow paths is that they are reasonably complex, and therefore costly, although providing greater sound reduction.

OBJECT

It is the object of the present invention to overcome or substantially ameliorate the above disadvantage.

SUMMARY OF INVENTION

There is disclosed herein a muffler assembly for an internal combustion engine exhaust, the assembly having an exhaust inlet, the assembly including:

a muffler having:

a casing surrounding a space and having opposite first and second end portions, the first end portion;

a first, a second and a third internal wall, each wall being located in the space to divide the space into a first, a second, a third and a fourth chamber with the first chamber being located between the first wall and the first end portion, the fourth chamber being located between the fourth wall and the second end portion, the second chamber being located between the first wall and the second wall, and the third chamber being located between the second wall and the third wall;

a first duct extending through said space from the inlet to a first exhaust outlet portion to provide for the flow of exhaust gas, along a passage provided by the first duct, to atmosphere;

a second duct, the second duct extending from the first chamber to the fourth chamber to provide for the flow of exhaust gas from the first chamber to the fourth chamber;

a plurality of apertures in the first duct providing for communication between the passage and said second chamber;

openings in said first duct providing for the flow of exhaust gas from said passage to said first chamber;

an opening in said third wall providing for the flow of exhaust gas between the third and fourth chambers;

at least one opening in said duct providing for the flow of exhaust gas between said passage and said third chamber; and wherein said valve includes:

a hollow valve body through which exhaust gas may pass and being mounted at said outlet external of said casing to provide for adjustable resistance to the flow of exhaust gas passing through said outlet from said passage; and a third duct extending from said third chamber to the exterior of said casing providing a second exhaust outlet portion for the flow of exhaust gas from said third chamber to atmosphere.

Preferably, said valve includes a hollow valve body communicating with said passage to provide for the flow of exhaust gas therefrom, a movable valve element in the valve passage operable to provide a variable resistance to exhaust gas flowing through the valve passage, and said third duct surrounds said valve body so that the second outlet portion surrounds said valve body and first outlet portion.

Preferably, said second chamber is provided with sound absorbing material.

Preferably, said movable valve member is a "butterfly" valve member pivotally mounted on the valve body so as to be angularly movable between an open position providing for the flow of exhaust gas through the valve body, and a closed position closing the valve passage.

BRIEF DESCRIPTION OF DRAWINGS

Preferred forms of the present invention will now be described by way of example with reference to the accompanying drawings wherein.

DESCRIPTION OF EMBODIMENTS

Figures 1, 2, 3:
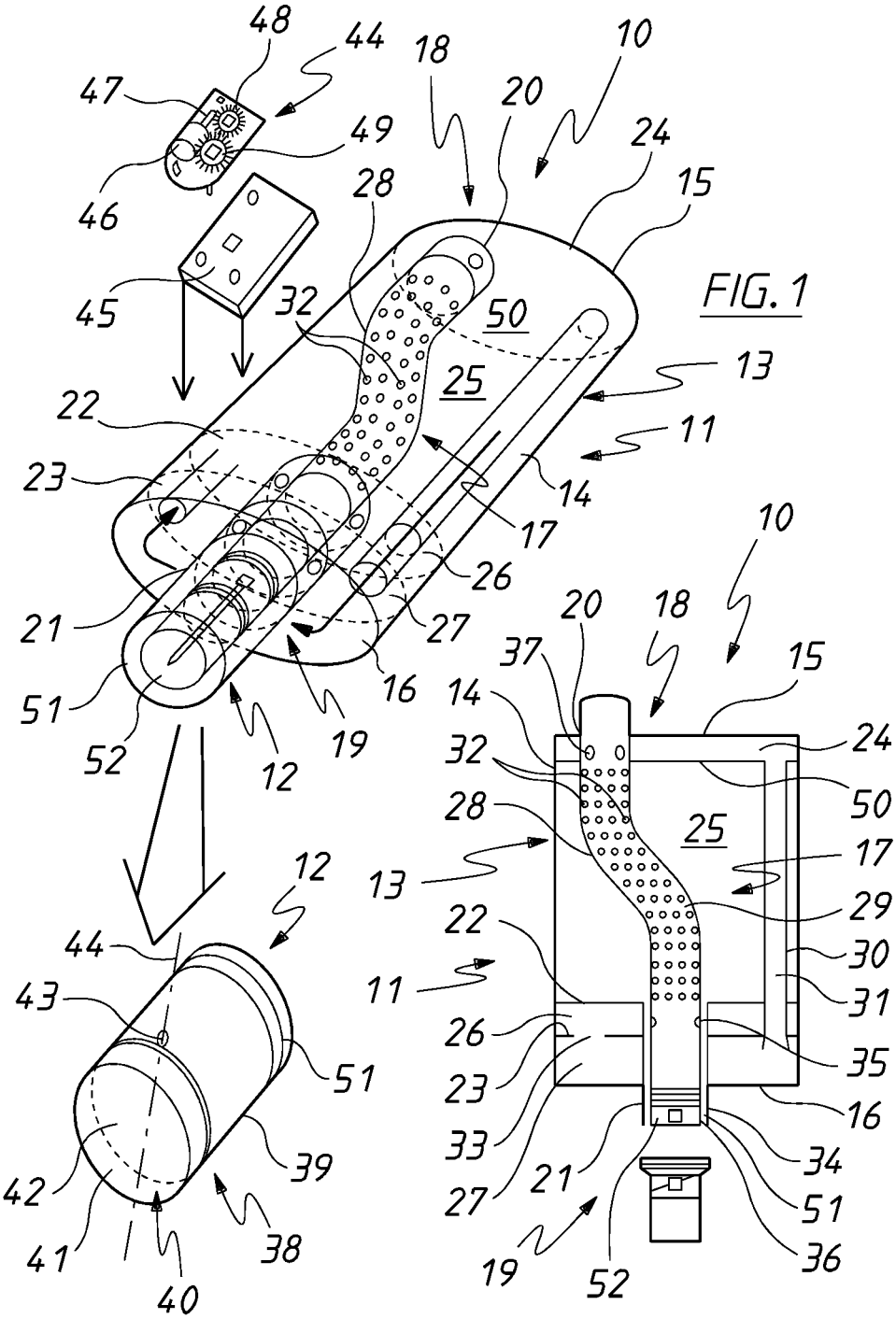
FIG. 1 is a schematic isometric view of a muffler assembly.
FIG. 2 is a schematic plan view of the muffler assembly of FIG. 1.
FIG. 3 is a schematic enlarged isometric view of a valve employed in the assembly of FIG. 1.

In FIGS. 1 to 3 of the accompanying drawings there is schematically depicted a muffler assembly 10. In this embodiment the muffler assembly 10 includes a muffler 11 and a valve 12.

The muffler 11 includes a casing 13 including a peripheral wall 14 that is of an oval configuration, joining opposite first and second end walls 15 and 16. The walls 14, 15 and 16 enclose a space 17, with the end wall 15 providing an end portion 18, and the wall 16 and end portion 19. The end portion 18 provides a muffler inlet 20 that is to be connected to the exhaust of an internal combustion engine, while the end portion 19 provides a muffler outlet 21.

Located in the space 17 is a first internal wall 50, a second internal wall 22, and a third internal wall 23. The walls 50, 22 and 23 are located in the space 17 so as to divide the space 17 into a first chamber 24, a second chamber 25, and a third 26 and a fourth chamber 27.

The first chamber 24 is located between the end portion 18 and the wall 50, the second chamber 25 is located between the walls 21 and 22, the third chamber 26 is located between the walls 22 and 23, while the fourth chamber 27 is located between the wall 23 and the end portion 19.

Extending from the inlet 20 to the outlet 21 is a first duct 28 providing a passage 29 providing for the flow of exhaust gas from the inlet 20 to an exhaust outlet portion 51 at the outlet 21 to be discharged to atmosphere.

Extending from the first chamber 24 to the fourth chamber 27 is a second duct 30 providing a passage 31 through which exhaust gas may pass between the chamber 24 and the chamber 27.

The portion of the duct 28 located in the chamber 25 is provided with a plurality of openings 32 providing for communication between the chamber 25 and the passage 29 for the purposes of sound absorption. Typically the chamber 25 would be provided with a sound absorbing material such as glass fibre.

The wall 23 has an opening 33 that provides for the flow of exhaust gas between the chambers 26 and 27.

Extending from the chamber 28 to the exterior of the muffler 11 is a third duct 34, having openings 35 providing for the flow of exhaust gas between the chamber 26 and the internal passage 36 of the duct 34.

The duct 28 has openings 37 providing for the flow of exhaust gas from the passage 29 to the first chamber 24.

Mounted in the downstream end of the duct 28 is the valve 12. The valve 12 includes a hollow valve body 39, with the body 39 in this embodiment being generally cylindrical in configuration. The body 39 surrounds a passage 40, with the passage 40 providing an exhaust gas outlet portion 52 at the outlet 21.

Mounted on the body 39 is a movable valve element 41. In this embodiment, the movable valve element 41 is a "butterfly" valve member 42 pivotally mounted in the body 39 by means of a shaft 43. The valve member 42 is angularly movable about the axis 44 provided by the shaft 43, between an open position providing for maximum flow (minimum resistance) to exhaust gas flowing through the passage 40, and a closed position at which the passage 40 is closed, providing maximum resistance to exhaust flow through the passage 40.

The shaft 43 is engaged by a motor assembly 44 that is operable to cause the angular movement of the valve member 42 about the axis 44.

The motor assembly 44 is operatively associated with the computer system of the motor vehicle, so that the computer system controls the position of the movable valve element 42. In an alternative embodiment, the element is controlled by a switch or other mechanism operated by the driver.

The motor assembly 44 includes a mounting plate 45 preferably mounted on the casing 14. Attached to the mounting plate 45 is an electric motor 46 operated by the computer system of the motor vehicle, or abovementioned mechanism or switch. The motor 46 drives a pinion worm gear 47 that causes angular movement of a further gear 48. Angular movement of the gear 48 causes angular movement of a further gear 49, with the shaft 43 fixed to the gear 49 so that angular movement of the gear 49 causes angular movement of the shaft 43 and therefore the valve element 42.

In the embodiment of FIGS. 1 to 3, the first duct member 48 follows a curved path.

Figure 5:
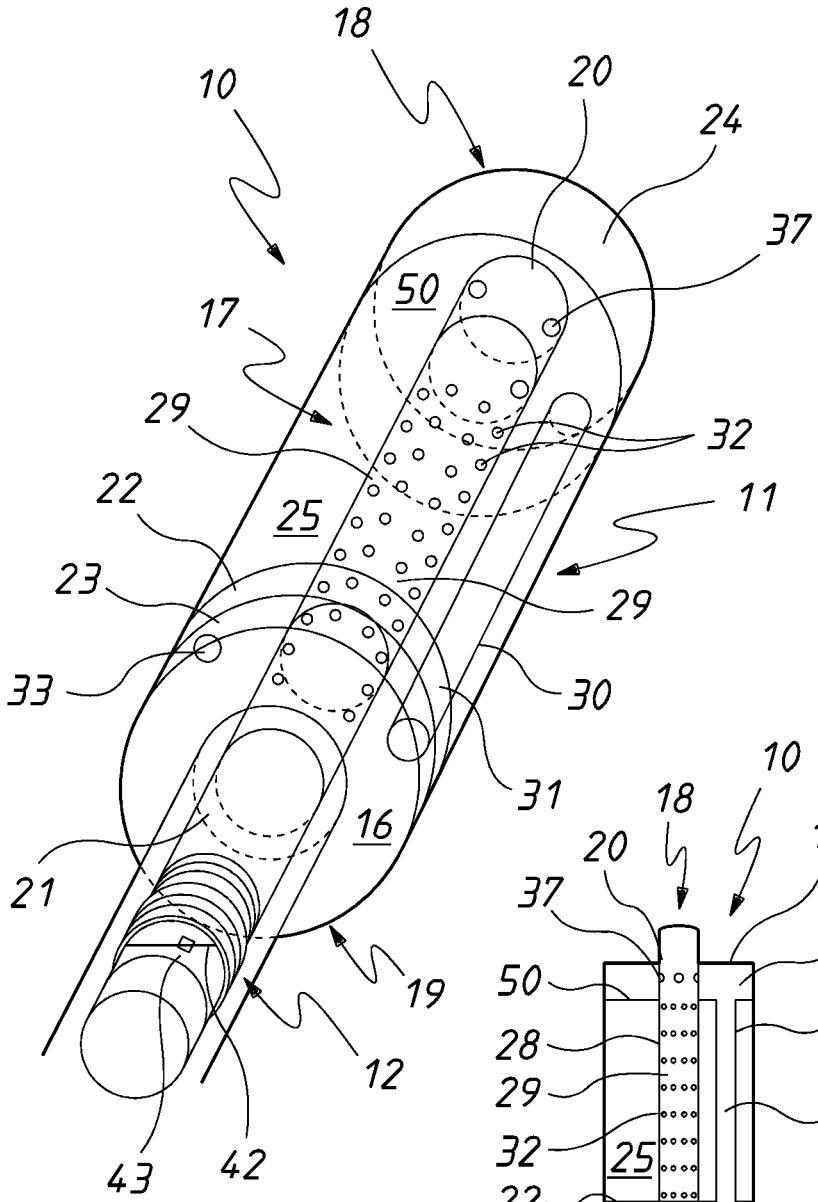
FIG. 5 is a schematic isometric view of the muffler assembly of FIG. 4.
Figure 4:
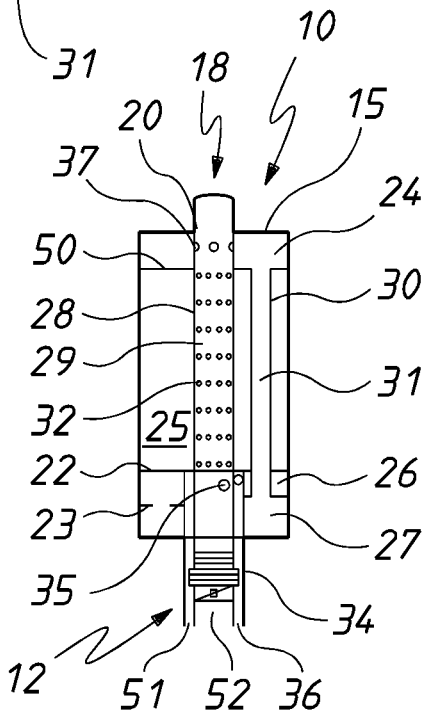
FIG. 4 is a schematic plan view of a modification of the muffler assembly of FIG. 1.

In the embodiment of FIGS. 4 and 5, the duct member 48 follows a generally straight path. Preferably the casing of the embodiment of FIGS. 4 and 5 is generally cylindrical.

In operation of the above described muffler assembly 10, under normal driving conditions the movable valve body 42 is in the closed position. The exhaust gas will travel from the inlet 20, through the openings 37 to travel through the chamber 24, the passage 31, the chamber 27, opening 33, chamber 26, and openings 35 to enter the passage 36 to be discharged to atmosphere via outlet portion 51. This exhaust path will maximize sound absorption. However, as exhaust flow rates increase, the motor 46 will move the movable valve element 42 angularly to a partly open position or a fully open position. Accordingly, this progressive movement of the valve element 42 will increase the volume of exhaust gas passing from the inlet 20 direct to the outlet 21 via the passage 29. Gas is discharged through both portions 51 and 52. In the fully open position the movable valve element 42 provides minimum resistance (minimum back pressure) to exhaust gas being delivered to the assembly 10. Exhaust gas is discharged to atmosphere via outlet portion 52.

The valve body 39 has a threaded length 51 that threadably engages the end extremity of the duct 28 so as to be attached thereto.

In respect of the outlet 21, the outlet portion 52, is a first outlet portion, and the outlet portion 51 a second outlet portion, with the outlet portion 51 surrounding the outlet portion 52.

The above described preferred embodiments have the advantage that the valve assembly 38 is mounted externally of the muffler 10, and therefore it is more easily installed, and retro fitted.

The invention claimed is:

1. A muffler assembly for an internal combustion engine exhaust, the assembly having an exhaust inlet, the assembly including:

a muffler having:

a casing surrounding a space and having opposite first and second end portions;

a first, a second and a third internal wall, each wall being located in the space to divide the space into a first, a second, a third and a fourth chamber with the first chamber being located between the first wall and the first end portion, the fourth chamber being located between the fourth wall and the second end portion, the second chamber being located between the first wall and the second wall, and the third chamber being located between the second wall and the third wall;

a first duct extending through said space from the inlet to a first exhaust outlet portion to provide for the flow of exhaust gas, along a passage provided by the first duct, to atmosphere;

a second duct, the second duct extending from the first chamber to the fourth chamber to provide for the flow of exhaust gas from the first chamber to the fourth chamber;

a plurality of apertures in the first duct providing for communication between the passage and said second chamber;

openings in said first duct providing for the flow of exhaust gas from said passage to said first chamber;

an opening in said third wall providing for the flow of exhaust gas between the third and fourth chambers;

at least one opening in said duct providing for the flow of exhaust gas between said passage and said third chamber; and wherein a valve includes:

a hollow valve body through which exhaust gas may pass and being mounted at said outlet external of said casing to provide for adjustable resistance to the flow of exhaust gas passing through said outlet from said passage; and a third duct extending from said third chamber to the exterior of said casing providing a second exhaust outlet portion for the flow of exhaust gas from said third chamber to atmosphere.

2. The muffler assembly of claim 1, wherein said valve includes the hollow valve body communicating with said passage to provide for the flow of exhaust gas therefrom, a movable valve element in the valve passage operable to provide a variable resistance to exhaust gas flowing through the valve passage, and said third duct surrounds said valve body so that the second outlet portion surrounds said valve body and first outlet portion.

3. The muffler assembly of claim 1, wherein said second chamber is provided with sound absorbing material.

4. The muffler assembly of claim 1, wherein said movable valve member is a "butterfly" valve member pivotally mounted on the valve body so as to be angularly movable between an open position providing for the flow of exhaust gas through the valve body, and a closed position closing the valve passage.

5. The muffler assembly of claim 2, wherein the second chamber is provided with sound absorbing material.

6. The muffler assembly of claim 2, wherein the movable valve member is a "butterfly" valve member pivotally mounted on the valve body so as to be angularly movable between an open position providing for flow of exhaust gas through the valve body, and a closed position closing the valve passage.

* * * * *